US008241083B2

(12) United States Patent
Fish

(10) Patent No.: US 8,241,083 B2
(45) Date of Patent: Aug. 14, 2012

(54) TOY PLANE

(76) Inventor: Peter Alan Fish, Killara (AU)

( * ) Notice: Subject to any disclaimer, the term of this patent is extended or adjusted under 35 U.S.C. 154(b) by 333 days.

(21) Appl. No.: 12/627,047

(22) Filed: Nov. 30, 2009

(65) Prior Publication Data

US 2011/0092127 A1 Apr. 21, 2011

(51) Int. Cl.
*A63H 27/00* (2006.01)

(52) U.S. Cl. ..... 446/67; 446/34; 283/56

(58) Field of Classification Search ..... 446/67; 283/56

See application file for complete search history.

(56) References Cited

FOREIGN PATENT DOCUMENTS

AU 2008100517 * 7/2008

* cited by examiner

*Primary Examiner* — Michael Dennis

(74) *Attorney, Agent, or Firm* — Baker & McKenzie LLP

(57) ABSTRACT

An toy return glider having a first sheet member with a head cover section, a wing section and a tail section disposed along a longitudinal axis, and a rear air intake duct disposed within a connecting area between the wing section and the tail section. The toy glider also has a second sheet member with a body and rudders disposed along the longitudinal axis. The body has two longitudinal fold lines parallel to the longitudinal axis, and when the second sheet member is folded upward, two first slots extend obliquely rearward and downward with the rear air intake duct cover coupled with the two first slots, and the head cover section bonds a front section of the body to form a front air intake duct. The toy glider enhances the structural strength, overall stability and life time of the glider.

21 Claims, 4 Drawing Sheets

TOY PLANE

TECHNICAL FIELD

The present utility model generally relates to return glider, and particularly to toy return glider with improved structure.

BACKGROUND ARTS

Toy return glider planes have been popular for years and many designs have been employed to achieve various appearances and performances. The most common design is in the form of a stunt plane or a World War II fighter plane. Such planes may either be made from paper or foam in two parts for simple assembly. When assembled into an aerodynamic shape, a weight may be positioned on the head of the plane. When thrown in a sideways action, the plane will return to the thrower. Alternately, the plane may be thrown upwards like a rocket and the weight in the head causes the plane to loop and again return to the thrower. However, the appearance of such return gliders is old fashioned, and the performance of the same is limited.

A toy return glider is disclosed in patent application No. 2008100517, submitted by the applicant of the present utility model in Australia. Such a toy return glider is in the form of a modern jet fighter, whose appearance is more appealing to the user of the toy. To meet required flight performance with the appearance of a modern jet fighter, two air intake ducts have been added to the body of the plane to provide additional lift and smooth airflow through and over the wing. The first air intake duct is at the nose of the body and allows airflow to pass air through the body as passing a jet engine intake when the user propels the craft. The second air intake duct is positioned at the rear of the wing on top of the body and allowing airflow that has traveled over the wing to enter the boy and under the tail section to assist with additional lift. As such, the added weight of the three dimension wing glider is now assisted by the two air intake ducts to appear and perform in the required manner. The design of employing two air intake ducts enables the toy return glider to achieve required performance with a modern jet fighter aircraft appearance. However, the coupling of the cover of the second air intake duct in such a toy return glider with the body lacks lateral confinement, and the coupling area of the rudder with the tail section lacks rigidity, causing drawbacks in structural strength and overall stability and reducing life time.

Therefore, there is need for a toy return glider with improved structural strength and overall stability and with increased life time.

SUMMARY OF THE UTILITY MODEL

One of the targets of the present utility model is to improve the structure of the rear air intake duct cover, so as to increase the structural strength and overall stability for the toy return glider. Another target of the present utility model is to improve the tail section and other structures, so as to further increase the structural strength and overall stability for the toy return glider and increase convenience and sensitivity in adjusting flight performance.

In accordance with one aspect of the present utility model, there is provided an improved toy return glider comprising: a first sheet member comprising sequentially, from front to rear, a head cover section, a wing section and a tail section disposed symmetrically with respect to the longitudinal axis of the toy return glider, wherein, a rear air intake duct is disposed symmetrically with respect to the longitudinal axis within a connecting area between the wing section and the tail section, and the rear air intake duct is formed by folding, downward and rearward, a rear air intake duct cover along a rear air intake duct fold line which is disposed symmetrically with respect to the longitudinal axis; and a second sheet member comprising sequentially, from front to rear, a body and rudders disposed symmetrically with respect to the longitudinal axis, wherein two first slots are disposed symmetrically with respect to the longitudinal axis between the body and the rudders, the body has two longitudinal fold lines disposed symmetrically with respect to, and parallel to, the longitudinal axis, and when the second sheet member is folded upward along the two longitudinal fold lines, the two first slots extend obliquely rearward and downward, the rear air intake duct cover is coupled with the two first slots, and the head cover section bonds a front section of the body to form a front air intake duct, the rear air intake duct cover has two notches disposed symmetrically with respect to the longitudinal axis on the rear end of the rear air intake duct cover, and the two notches are coupled with the two first slots respectively.

In accordance one embodiment of the present utility model, two second slots are disposed symmetrically with respect to the longitudinal axis in the middle of rear end of the tail section, and two third slots are disposed symmetrically with respect to the longitudinal axis on the front edges of the rudders, and when the second sheet member is folded upward along the two longitudinal fold lines, the two third slots extend obliquely rearward and upward, the two second slots are coupled with the two third slots respectively, and the area between the two longitudinal fold lines forms a bottom of the body.

In accordance another embodiment of the present utility model, the rear end of the rear air intake duct cover is formed by two bevel edges intersecting rearward, and the two notches are formed on the two bevel edges respectively.

In accordance another embodiment of the present utility model, the two second slots, which extend forward from the rear and of the tail section, are configured as two elongated slots with substantially a uniform width, and the two second slots engage the two third slots respectively. In an example, the width of each of the two notches may be greater than the width of each of the two second slots. In an example, the width of each of the two notches may be twice as great as the width of each of the two second slots.

In accordance another embodiment of the present utility model, a tail section fold line is disposed between two front ends of the two second slots.

In accordance another embodiment of the present utility model, the two second slots extend obliquely rearward and outward from two front ends of the two second slots respectively.

In accordance another embodiment of the present utility model, the center distance between the two notches is substantially in accordance with the center distance between two front ends of the two second slots.

In accordance another embodiment of the present utility model, the center distance between the two notches is greater than the center distance between two front ends of the two second slots.

In accordance another embodiment of the present utility model, connecting fold lines are disposed between the wing section and the tail section.

In accordance another embodiment of the present utility model, wing end fold lines are disposed on the two ends of the wing section respectively.

In accordance another embodiment of the present utility model, the toy return glider further comprising a weight disposed within the head of the toy return glider. In one example, the weight may be a weight sheet with a shape at least partially corresponding to the head cover section and two sides of the front section, the weight sheet bonds the head cover section and two sides of the front section to form the front air intake duct. In one example, the weight sheet may comprise a first weight portion, a second weight portion and a third portion connected together with two weight fold lines, wherein the second weight portion is at least partially in accordance with the head cover section, and the first weight portion and the third portion are at least partially in accordance with and two sides of the front section respectively.

In accordance another embodiment of the present utility model, the angle $\theta_1$ between any one of the two first slots and the two longitudinal fold lines is about 16 degrees to about 24 degrees, preferably about 20 degrees.

In accordance another embodiment of the present utility model, the angle $\theta_2$ between any one of the two third slots and the two longitudinal fold lines is about 12 degrees to about 18 degrees, preferably about 15 degrees.

In accordance another embodiment of the present utility model, when the second sheet member is folded upward along the two longitudinal fold lines, the angle $\theta_3$ between two sides adjoining the bottom on the rear portion of the body is about 20 degrees to about 30 degrees, preferably about 25 degrees.

By means of structural improvement, the toy return glider of the present utility increases the structural strength, overall stability and life time, as well as increases convenience and sensitivity in adjusting flight performance and flight path.

DESCRIPTION OF THE DRAWINGS

The present utility model will be better understood by referring to illustration of embodiments thereof, in which.

DETAILED EMBODIMENTS

In the description below, for the purposes of explanation, numerous specific details are set forth in order to provide a thorough understanding of the present utility model. It will be apparent, however, to one skilled in the art that the present utility model may be practiced without some of these specific details. The particular illustrated example embodiments are not provided to limit the utility model but merely to illustrate it. Thus, the scope of the present utility model is not to be determined by the specific examples provided above but only by the plain language of the appended claims.

Figure 1:
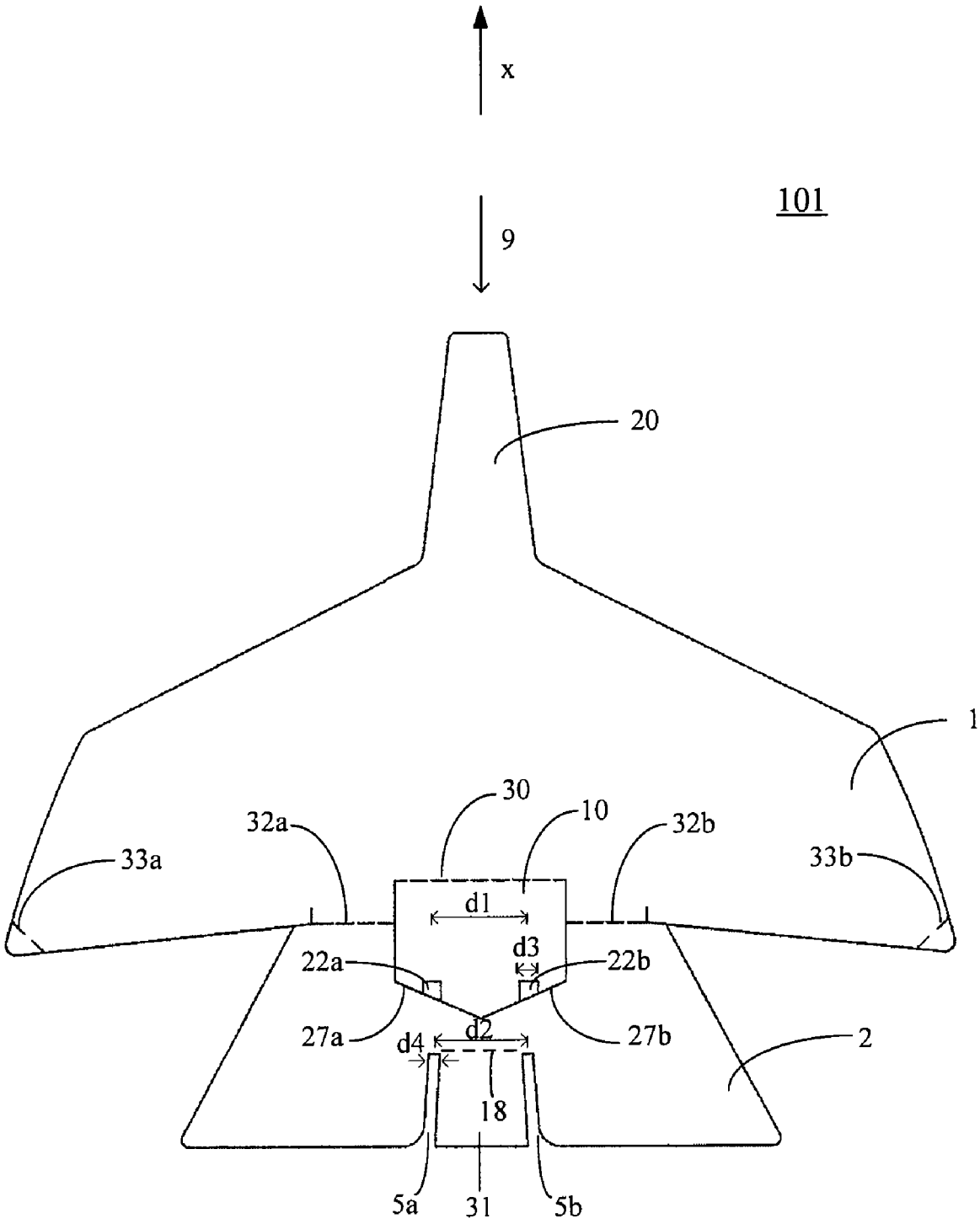
FIG. 1 is a schematic drawing showing a first sheet member 101 of the toy return glider 100 in accordance with one embodiment of the present utility model.
Figure 2:
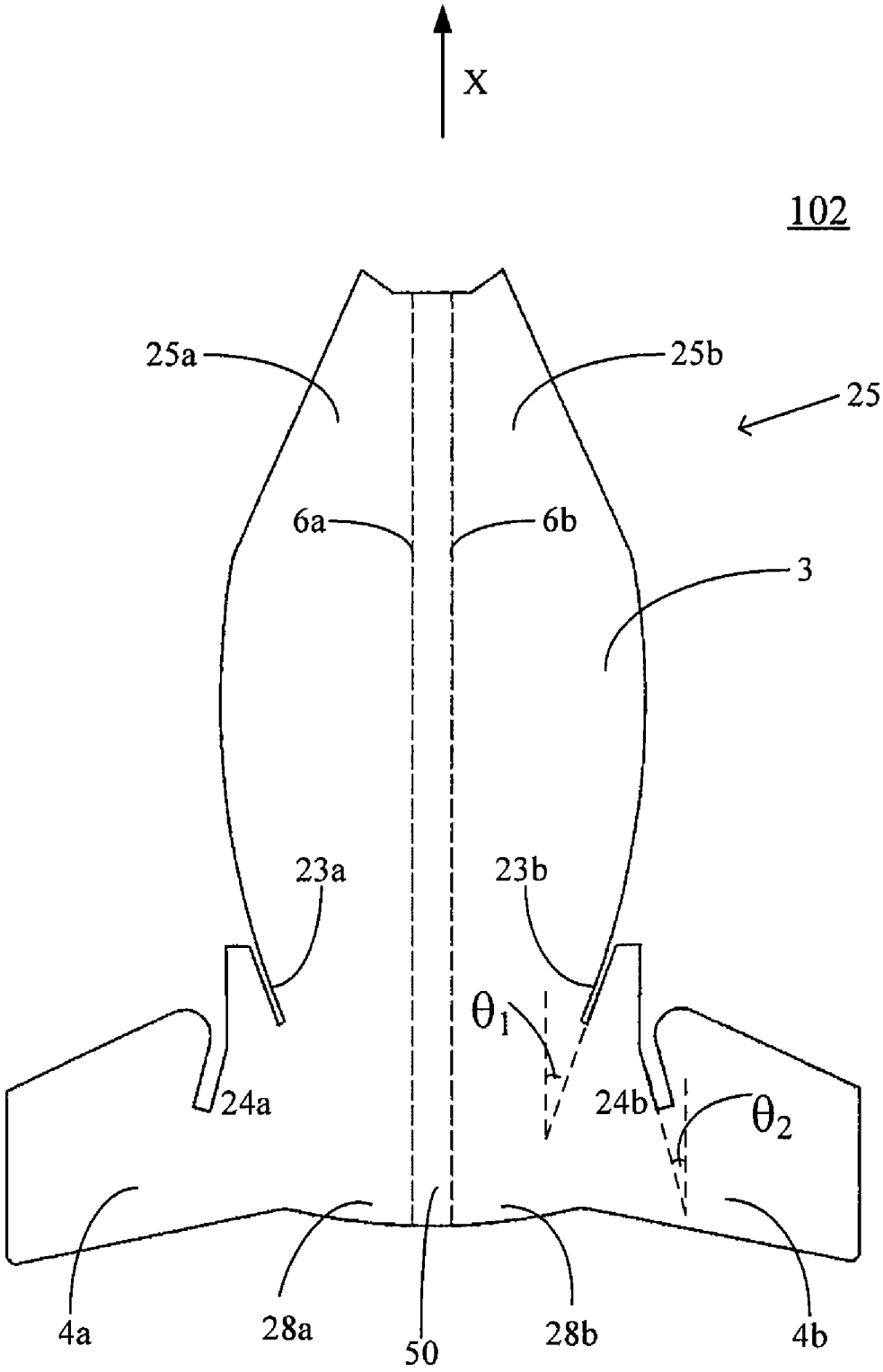
FIG. 2 is a schematic drawing showing a second sheet member 102 of the toy return glider 100 in accordance with one embodiment of the present utility model.
Figure 4:
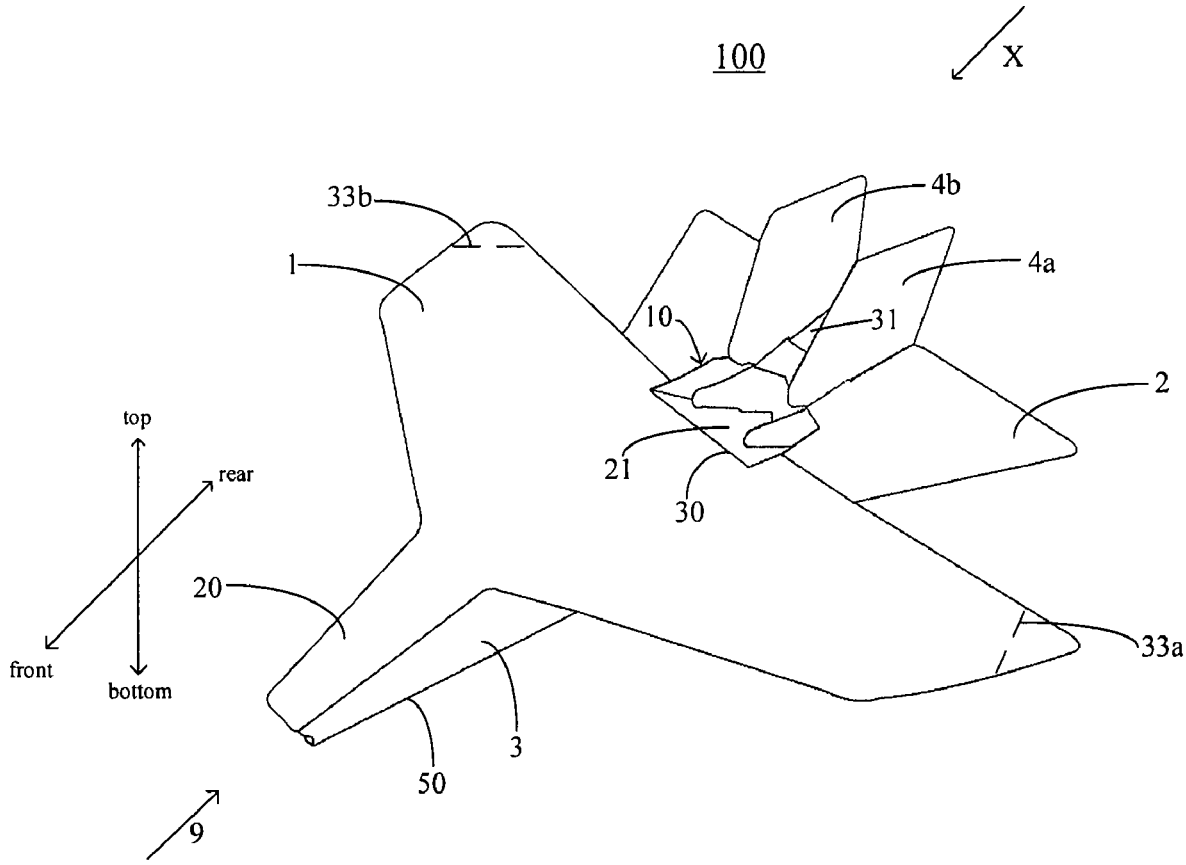
FIG. 4 is a perspective schematic drawing of the assembled toy return glider 100 in accordance with one embodiment of the present utility model.

First referring to FIGS. 1, 2 and 4, wherein FIG. 1 is a schematic drawing showing a first sheet member 101 of the toy return glider 100 in accordance with one embodiment of the present utility model, FIG. 2 is a schematic drawing showing a second sheet member 102 of the toy return glider 100 in accordance with one embodiment of the present utility model, and FIG. 4 is a perspective schematic drawing of the assembled toy return glider 100 in accordance with one embodiment of the present utility model. In all the figures, a central longitudinal axis of the toy return glider is referred by X, and all components are symmetrically disposed with respect to the longitudinal axis X unless expressly indicated. The first sheet member 101 and the second sheet member 102 may be cropped, punched or die cut from a paper sheet or foam sheet, though those skilled in the art will understand that the present utility model is not so limited.

Referring to FIG. 1, the first sheet member 101 may comprise sequentially, from front to rear, a head cover section 20, a wing section 1 and a tail section 2 disposed symmetrically with respect to the longitudinal axis X of the toy return glider. A rear air intake duct 10 is disposed symmetrically with respect to the longitudinal axis X within a connecting area between the wing section 1 and the tail section 2. The rear air intake duct 10 is formed by folding, downward and rearward, a rear air intake duct cover 21 along a rear air intake duct fold line 30 which is disposed symmetrically with respect to the longitudinal axis X.

Referring to FIG. 2, the second sheet member 102 may comprise sequentially, from front to rear, a body 3 and rudders 4*a*, 4*b* disposed symmetrically with respect to the longitudinal axis X. Two first slots 23*a*, 23*b* are disposed symmetrically with respect to the longitudinal axis X between the body 3 and the rudders 4*a*, 4*b*. The body 3 has two longitudinal fold lines 6*a*, 6*b* disposed symmetrically with respect to, and parallel to, the longitudinal axis X, and when the second sheet member 102 is folded upward along the two longitudinal fold lines 6*a*, 6*b*, the two first slots 23*a*, 23*b* extend obliquely rearward and downward, the rear air intake duct cover 21 is coupled with the two first slots 23*a*, 23*b*, and the head cover section 20 bonds a front section 25 of the body 3 to form a front air intake duct 9. The rear air intake duct cover 21 has two notches 22*a*, 22*b* disposed symmetrically with respect to the longitudinal axis X on the rear end of the rear air intake duct cover 21, and the two notches 22*a*, 22*b* are coupled with the two first slots 23*a*, 23*b* respectively.

Two second slots 5*a*, 5*b* may be disposed symmetrically with respect to the longitudinal axis X in the middle of rear end of the tail section 2, and two third slots 24*a*, 24*b* may be disposed symmetrically with respect to the longitudinal axis X on the front edges of the rudders 4*a*, 4*b*, and when the second sheet member 102 is folded upward along the two longitudinal fold lines 6*a*, 6*b*, the two third slots 24*a*, 24*b* extend obliquely rearward and upward, the two second slots 5*a*, 5*b* are coupled with the two third slots 24*a*, 24*b* respectively, and the area between the two longitudinal fold lines 6*a*, 6*b* forms a bottom 50 of the body 3.

The rear end of the rear air intake duct cover 21 is formed by two bevel edges 27*a*, 27*b* intersecting rearward, and the two notches 22*a*, 22*b* are formed on the two bevel edges 27*a*, 27*b* respectively. In FIG. 1, the rear end of the rear air intake duct cover 21 is illustrated as two rearward intersecting bevel edges 27*a*, 27*b*, but those skilled in the art will understand that other solutions are possible, for example, structure such as a straight edge or two arc lines and so on may be used instead of these two bevel edges, and the present utility model is not so limited. In FIG. 1, the notches 22*a*, 22*b* are illustrated as generally rectangular notches, but those skilled in the art will understand that other solutions are possible, for example, structure such as half elliptical notches, trapezoidal notches and so on may be used instead of these two rearward intersecting bevel edges, and the present utility model is not so limited. The notches 22*a*, 22*b* not only make the coupling between the rear air intake duct cover 21 and the two first slots 23*a*, 23*b* an engaging structure with greater structural strength, but also enhance the overall structural stability by avoiding the middle and rear sections of the hollow body deforming too much.

The two second slots 5*a*, 5*b*, which extend forward from the rear and of the tail section 2, are configured as two elongated slots with substantially a uniform width, and the two second slots 5*a*, 5*b* engage the two third slots 24*a*, 24*b* respectively. The width d3 of each of the two notches 22*a*, 22*b* may be greater than the width d4 of each of the two second slots 5*a*, 5*b*. The width d3 of each of the two notches 22*a*, 22*b* may be approximately twice as great as the width (d4) of each of the two second slots 5*a*, 5*b*. The two second slots 5*a*, 5*b* take the forms of two elongated slots with substantially a uniform width, which further enhances the structural strength and overall stability of the respective coupling of the two second slots 5*a*, 5*b* with the two third slots 24*a*, 24*b*.

A tail section fold line 18 is disposed between two front ends of the two second slots 5*a*, 5*b*. Thanks to the fold line 18, the tail cover 31 may be tuned upwardly and downwardly, to adjust the resistance uncounted by the toy and the return distance. For example, folding the tail cover 31 upwardly along the fold line 18 (i.e., toward the rudder) may reduce the return distance. Since the area of the tail cover 31 in the present utility model is as great as possible, the sensitivity of the flight adjustment is improved.

The two second slots 5*a*, 5*b* may extend obliquely rearward and outward from two front ends of the two second slots 5*a*, 5*b* respectively. The outward oblique angle is in the range of about 0 to 15 degree.

The center distance d1 between the two notches 22*a*, 22*b* may be substantially in accordance with the center distance d2 between two front ends of the two second slots 5*a*, 5*b*. The center distance d1 between the two notches 22*a*, 22*b* may be greater than the center distance d2 between two front ends of the two second slots 5*a*, 5*b*.

Connecting fold lines 32*a*, 32*b* are disposed between the wing section 1 and the tail section 2. The connecting fold line 32*a*, 32*b* makes the wing section 1 arching upwardly after assembly, which achieves the required aerodynamic shape and provides required lift. Additionally, wing end fold lines 33*a*, 33*b* may be disposed on the two ends of the wing section 1 respectively. The wing end fold lines 33*a*, 33*b* may both be folded upwardly or downwardly, or one upwardly while the other downwardly, or even both be removed, to obtain different flight paths and performances.

As shown in FIG. 2, the angle $\theta_1$ between any one of the two first slots 23*a*, 23*b* and the two longitudinal fold lines 6*a*, 6*b* is about 16 degrees to about 24 degrees, preferably about 20 degrees. The angle $\theta_2$ between any one of the two third slots 24*a*, 24*b* and the two longitudinal fold lines 6*a*, 6*b* is about 12 degrees to about 18 degrees, preferably about 15 degrees. When the second sheet member 102 is folded upward along the two longitudinal fold lines 6*a*, 6*b* and the assembly of the toy return glider 100 is completed, the angle $\theta_3$ (not shown in the Figures) between two sides 28*a*, 28*b* adjoining the bottom 50 on rear portion of the body 3 is about 20 degrees to about 30 degrees, preferably about 25 degrees. Although the embodiments of the present utility model are described by these parameters achieved through undue experiments, those skilled in the art will understand that other bonding manners are possible, and the present utility model is not so limited. Testing approves that these parameters are helpful in achieve better performance of a toy return glider.

Figure 3:
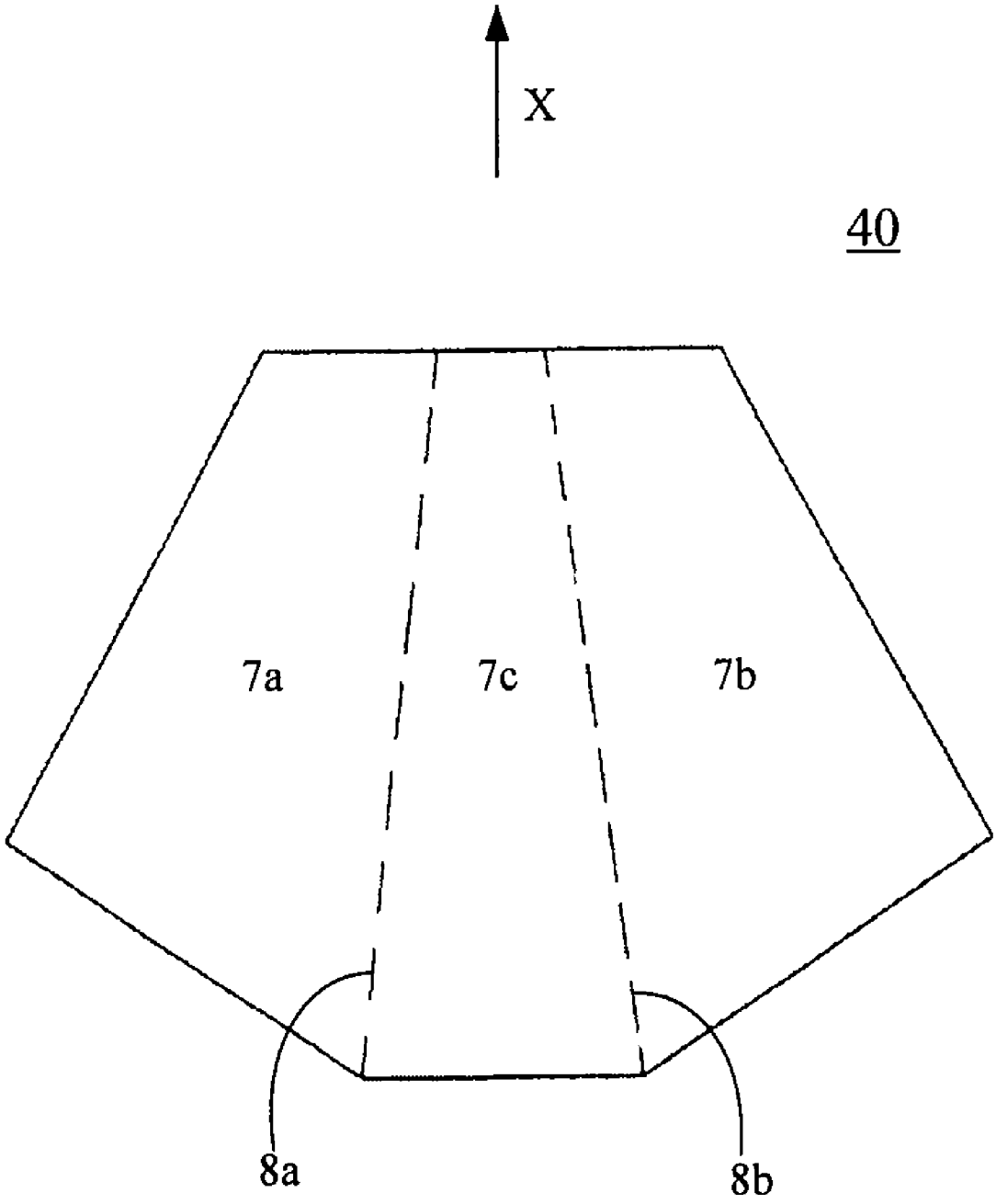
FIG. 3 is a schematic drawing showing a weight 40 of the toy return glider 100 in accordance with one embodiment of the present utility model.

FIG. 3 is a schematic drawing showing a weight 40 of the toy return glider 100 in accordance with one embodiment of the present utility model. The weight 40 is disposed within the head of the toy return glider, and is a weight sheet 40 with a shape at least partially corresponding to the head cover section 20 and two sides 25*a*, 25*b* of the front section 25, the weight sheet 40 bonds the head cover section 20 and two sides 25*a*, 25*b* of the front section 25 to form the front air intake duct 9. The bonding between the weight sheet 40 with the head cover section 20 and the two sides 25*a*, 25*b* of the front section 25 may be in the form of glue sticking, such as applying adhesive in advance on the weight sheet 40, but those skilled in the art will understand that other bonding manners are possible, and the present utility model is not so limited.

The weight sheet 40 comprises a first weight portion 7*a*, a second weight portion 7*c* and a third portion 7*b* connected together with two weight fold lines 8*a*, 8*b*, wherein the second weight portion 7*c* is at least partially in accordance with the head cover section 20, and the first weight portion 7*a* and the third portion 7*b* are at least partially in accordance with and two sides 25*a*, 25*b* of the front section 25 respectively. Although a specific example of the weight sheet 40 is described in FIG. 3, those skilled in the art will understand that other structures and shapes are possible, and the present utility model is not so limited.

In general, by means of structural improvement, the toy return glider of the present utility increases the structural strength, overall stability and life time, as well as increases convenience and sensitivity in adjusting flight performance and flight path.

While the present utility model has been described with respect to a limited number of embodiments, those skilled in the art will appreciate numerous modifications and variations therefrom. It is intended that that the appended claims cover all such modifications and variations as fall within the true spirit and scope of this present utility model.

What is claimed is:

1. An improved toy return glider, comprising a first sheet member (101) comprising sequentially, from front to rear, a head cover section (20), a wing section (1) and a tail section (2) disposed symmetrically with respect to the longitudinal axis (X) of the toy return glider, wherein, a rear air intake duct (10) is disposed symmetrically with respect to the longitudinal axis (X) within a connecting area between the wing section (1) and the tail section (2), and the rear air intake duct (10) is formed by folding, downward and rearward, a rear air intake duct cover (21) along a rear air intake duct fold line (30) which is disposed symmetrically with respect to the longitudinal axis (X); and a second sheet member (102) comprising sequentially, from front to rear, a body (3) and rudders (4*a*, 4*b*) disposed symmetrically with respect to the longitudinal axis (X), wherein two first slots (23*a*, 23*b*) are disposed symmetrically with respect to the longitudinal axis (X) between the body (3) and the rudders (4*a*, 4*b*), the body (3) has two longitudinal fold lines (6*a*, 6*b*) disposed symmetrically with respect to, and parallel to, the longitudinal axis (X), and when the second sheet member (102) is folded upward along the two longitudinal fold lines (6*a*, 6*b*), the two first slots (23*a*, 23*b*) extend obliquely rearward and downward, the rear air intake duct cover (21) is coupled with the two first slots (23*a*, 23*b*), and the head cover section (20) bonds a front section (25) of the body (3) to form a front air intake duct (9), characterized in that, the rear air intake duct cover (21) has two notches (22*a*, 22*b*) disposed symmetrically with respect to the longitudinal axis (X) on the rear end of the rear air intake duct cover (21), and the two notches (22*a*, 22*b*) are coupled with the two first slots (23*a*, 23*b*) respectively, characterized in that, two second slots (5*a*, 5*b*) are disposed symmetrically with respect to the longitudinal axis (X) in the middle of rear end of the tail section (2), and two third slots (24*a*, 24*b*) are disposed symmetrically with respect to the longitudinal axis (X) on the front edges of the rudders (4*a*, 4*b*), and when the second sheet member (102) is folded upward along the two longitudinal fold lines (6*a*, 6*b*), the two third slots (24*a*, 24*b*) extend obliquely rearward and upward, the two second slots (5*a*, 5*b*) are coupled with the two third slots (24*a*, 24*b*) respectively, and the area between the two longitudinal fold lines (6*a*, 6*b*) forms a bottom (50) of the body (3).

2. The improved toy return glider of claim 1, characterized in that, the rear end of the rear air intake duct cover (21) is formed by two bevel edges (27*a*, 27*b*) intersecting rearward, and the two notches (22*a*, 22*b*) are formed on the two bevel edges (27*a*, 27*b*) respectively.

3. The improved toy return glider of claim 1, characterized in that, the two second slots (5*a*, 5*b*) , which extend forward from the rear and of the tail section (2), are configured as two elongated slots with substantially a uniform width, and the two second slots (5*a*, 5*b*) engage the two third slots (24*a*, 24*b*) respectively.

4. The improved toy return glider of claim 3, characterized in that, the width (d3) of each of the two notches (22*a*, 22*b*) is greater than the width (d4) of each of the two second slots (5*a*, 5*b*).

5. The improved toy return glider of claim 3, characterized in that, the width (d3) of each of the two notches (22*a*, 22*b*) is twice as great as the width (d4) of each of the two second slots (5*a*, 5*b*).

6. The improved toy return glider of claim 1, characterized in that, a tail section fold line (18) is disposed between two front ends of the two second slots (5*a*, 5*b*).

7. The improved toy return glider of claim 1, characterized in that, the two second slots (5*a*, 5*b*) extend obliquely rearward and outward from two front ends of the two second slots (5*a*, 5*b*) respectively.

8. The improved toy return glider of claim 1, characterized in that, the center distance (d1) between the two notches (22*a*, 22*b*) is substantially in accordance with the center distance (d2) between two front ends of the two second slots (5*a*, 5*b*).

9. The improved toy return glider of claim 1, characterized in that, the center distance (d1) between the two notches (22*a*, 22*b*) is greater than the center distance (d2) between two front ends of the two second slots (5*a*, 5*b*).

10. The improved toy return glider of claim 1, characterized in that, connecting fold lines (32*a*, 32*b*) are disposed between the wing section (1) and the tail section (2).

11. The improved toy return glider of claim 1, characterized in that, wing end fold lines (33*a*, 33*b*) are disposed on the two ends of the wing section (1) respectively.

12. The improved toy return glider of claim 1, characterized in that, the toy return glider further comprising a weight (40) disposed within the head of the toy return glider.

13. The improved toy return glider of claim 12, characterized in that, the weight (40) is a weight sheet with a shape at least partially corresponding to the head cover section (20) and two sides (25*a*, 25*b*) of the front section (25), the weight sheet bonds the head cover section (20) and two sides (25*a*, 25*b*) of the front section (25) to form the front air intake duct (9).

14. The improved toy return glider of claim 13, characterized in that, the weight sheet (40) comprises a first weight portion (7*a*), a second weight portion (7*c*) and a third portion (7*b*) connected together with two weight fold lines (8*a*, 8*b*) , wherein the second weight portion (7*c*) is at least partially in accordance with the head cover section (20), and the first weight portion (7*a*) and the third portion (7*b*) are at least partially in accordance with and two sides (25*a*, 25*b*) of the front section (25) respectively.

15. The improved toy return glider of claim 1, characterized in that, the angle $\theta_1$ between any one of the two first slots (23*a*, 23*b*) and the two longitudinal fold lines (6*a*, 6*b*) is about 16 degrees to about 24 degrees, preferably about 20 degrees.

16. The improved toy return glider of claim 1, characterized in that, the angle $\theta_2$ between any one of the two third slots (24*a*, 24*b*) and the two longitudinal fold lines (6*a*, 6*b*) is about 12 degrees to about 18 degrees, preferably about 15 degrees.

17. The improved toy return glider of claim 1, characterized in that, when the second sheet member (102) is folded upward along the two longitudinal fold lines (6*a*, 6*b*), the angle $\theta_3$ between two sides (28*a*, 28*b*) adjoining the bottom (50) on the rear portion of the body (3) is about 20 degrees to about 30 degrees, preferably about 25 degrees.

18. The improved toy return glider of claim 1, characterized in that, connecting fold lines (32*a*, 32*b*) are disposed between the wing section (1) and the tail section (2).

19. The improved toy return glider of claim 1, characterized in that, wing end fold lines (33*a*, 33*b*) are disposed on the two ends of the wing section (1) respectively.

20. The improved toy return glider of claim 1, characterized in that, the toy return glider further comprising a weight (40) disposed within the head of the toy return glider.

21. The improved toy return glider of claim 1, characterized in that, the rear end of the rear air intake duct cover (21) is formed by two bevel edges (27*a*, 27*b*) intersecting rearward, and the two notches (22*a*, 22*b*) are formed on the two bevel edges (27*a*, 27*b*) respectively.

* * * * *

UNITED STATES PATENT AND TRADEMARK OFFICE

CERTIFICATE OF CORRECTION

PATENT NO. : 8,241,083 B2
APPLICATION NO. : 12/627047
DATED : August 14, 2012
INVENTOR(S) : Peter Alan Fish It is certified that error appears in the above-identified patent and that said Letters Patent is hereby corrected as shown below:

On the title page, add item [30]:

Foreign Application Priority Data - October 21, 2009 (CN) 200920219776.7

Signed and Sealed this
Second Day of July, 2013

Teresa Stanek Rea

Teresa Stanek Rea
*Acting Director of the United States Patent and Trademark Office*